US010246167B2

(12) United States Patent
Frabetti

(10) Patent No.: US 10,246,167 B2
(45) Date of Patent: Apr. 2, 2019

(54) BOAT HAVING A MOVABLE STERN HATCH WITH A SUBMERSIBLE STERN PLATFORM

(71) Applicant: FERRETTI S.P.A., Cattolica (Rimini) (IT)

(72) Inventor: Andrea Frabetti, Zola Predosa (IT)

( * ) Notice: Subject to any disclaimer, the term of this patent is extended or adjusted under 35 U.S.C. 154(b) by 0 days.

(21) Appl. No.: 15/736,810

(22) PCT Filed: Jun. 23, 2015

(86) PCT No.: PCT/IB2015/054686
§ 371 (c)(1),
(2) Date: Dec. 15, 2017

(87) PCT Pub. No.: WO2016/207693
PCT Pub. Date: Dec. 29, 2016

(65) Prior Publication Data
US 2018/0362120 A1 Dec. 20, 2018

(51) Int. Cl.
*B63B 27/14* (2006.01)
*B63B 27/36* (2006.01)
*B63B 29/02* (2006.01)

(52) U.S. Cl.
CPC ..... *B63B 27/143* (2013.01); *B63B 27/14* (2013.01); *B63B 27/36* (2013.01); *B63B 2027/141* (2013.01); *B63B 2029/022* (2013.01)

(58) Field of Classification Search
CPC ..... B63B 27/143; B63B 27/14; B63B 27/36
See application file for complete search history.

(56) References Cited

U.S. PATENT DOCUMENTS

| | | | | |
|---|---|---|---|---|
| 8,833,290 | B2 * | 9/2014 | Mueller | B63B 27/14 114/343 |
| 9,168,981 | B2 * | 10/2015 | Ferretti | B63B 19/14 |
| 9,592,887 | B2 * | 3/2017 | Frabetti | B63B 27/143 |
| 9,725,139 | B2 * | 8/2017 | Frabetti | B63B 27/14 |
| 9,840,308 | B2 * | 12/2017 | Frabetti | B63B 19/08 |
| 2010/0288179 | A1 | 11/2010 | Grimaldi | |
| 2013/0220207 | A1 * | 8/2013 | Mueller | B63B 27/146 114/362 |

FOREIGN PATENT DOCUMENTS

WO 2014181269 A1 11/2014

OTHER PUBLICATIONS

International Search Report and Written Opinion dated Apr. 11, 2016 for PCT/IB2015/054686 to Ferretti S.P.A. filed Jun. 23, 2015.

* cited by examiner

*Primary Examiner* — Stephen P Avila
(74) *Attorney, Agent, or Firm* — Vorys, Sater, Seymour and Pease LLP

(57) ABSTRACT

A boat includes a hull provided with a rear stern hatch located in correspondence with an internal stern compartment of the hull and suitable for opening and closing in correspondence with an aperture of the compartment. The hatch having a body with opposed sides located in correspondence with side walls of the compartment and upper edge and lower edge. The hull having a stern platform that is movable and submersible. The hatch is not provided with any direct connections to the hull, but it is connected to the stern platform to reach, upon opening, a position submersed in the water where the boat is located in the moment when the platform submerges into the water.

8 Claims, 10 Drawing Sheets

BOAT HAVING A MOVABLE STERN HATCH WITH A SUBMERSIBLE STERN PLATFORM

CROSS-REFERENCE TO RELATED APPLICATIONS

This is a § 371 National Stage Application of International Application No. PCT/IB2015/054686 filed on Jun. 23, 2015.

The object of the present invention is a boat according to the preamble of the main claim.

Boats having a stern compartment provided with at least one closing stern hatch of its own are known for a long time. Such a compartment is used, for instance, to house a small boat or a tender. It is also known that in the stern portion, many prestigious boats have a stern platform determined by a projecting plane suitable for operating as a "small beach" for the boat's passengers.

With reference to said hatch, it can be moved with the purpose of freeing or closing an aperture to access the stern compartment (from the sea or from the stern platform). For this purpose, actuating members are usually provided, usually in the form of telescopic members which constrain the body of the hatch to side walls of the stern compartment.

The requirement is also known of allowing an easy submersion of the tender into the water and an easy recovery thereof into the hull. This is advantageously obtained by making the stern platform movable with respect to the hull and such as to make it possible to submerge it into the water on which the boat floats. This frees the access of the tender into the water and its picking up from the surface, for instance from the sea whenever the tender or rubber dinghy is to be hauled in and put again in the hull. For this purpose, the platform is made movable, for instance, by means of telescopic systems supporting and constraining the platform to the hull which can maintain and/or bring said stern platform in a first position above the water surface (or nearby), in a second position wherein it is submerged therein. In the first position, external to water, such platform can be used as a "small beach" on the rear side of the boat.

The presence of such stern platform offers comfort to the people on board the boat, a comfort that is directly proportional to the surface of the platform: the wider is it, the more is the "small beach" offered to such people. However, on the contrary, this is at odds with the need for having no rear or stern parts projecting from the hull in order to make its berthing in harbors easier. It follows that each stern platforms necessarily have reduced dimensions as to their extension from the hull.

There is therefore the need to have a boat provided with a stern compartment suitable for enclosing a tender or a rubber dinghy in which such a compartment is floodable.

There is also the need to have a boat with a stern "small beach" having dimensions greater than that of stern platform according to the state of the art, but such that they are not a hindrance during the movements of berthing in harbors.

The purpose of the present invention is to offer a boat that is enhanced with respect to the boats known at present.

Specifically, a purpose of the present invention is to offer a boat provided with a stern compartment enclosed by its own hatch in which it is simultaneously possible for the people on board the boat to benefit from a rear "small beach" having relatively remarkable dimensions, wider than those of the stern platform, and at the same time to make it possible a flood of the stern compartment in order to allow an easy movement from and inside said stern compartment of a tender or rubber dinghy.

Another purpose is to offer a boat of the mentioned type that is easy to moor or whose stern can be approached to a pier in a way not hindered by the presence of an extended stern platform.

A further purpose is to offer a boat where the rear small beach has a large surface to lean on, with reduced or absent elements jutting out or connecting to the hull, which would make its use by people on board the boat difficult or dangerous.

These purposes and others which will be apparent to those expert in the art are achieved by a boat according to the attached claims.

For a better understanding of the present invention the following drawings are attached for purely explanatory, non-limiting, purposes, of which:

Figure 1:
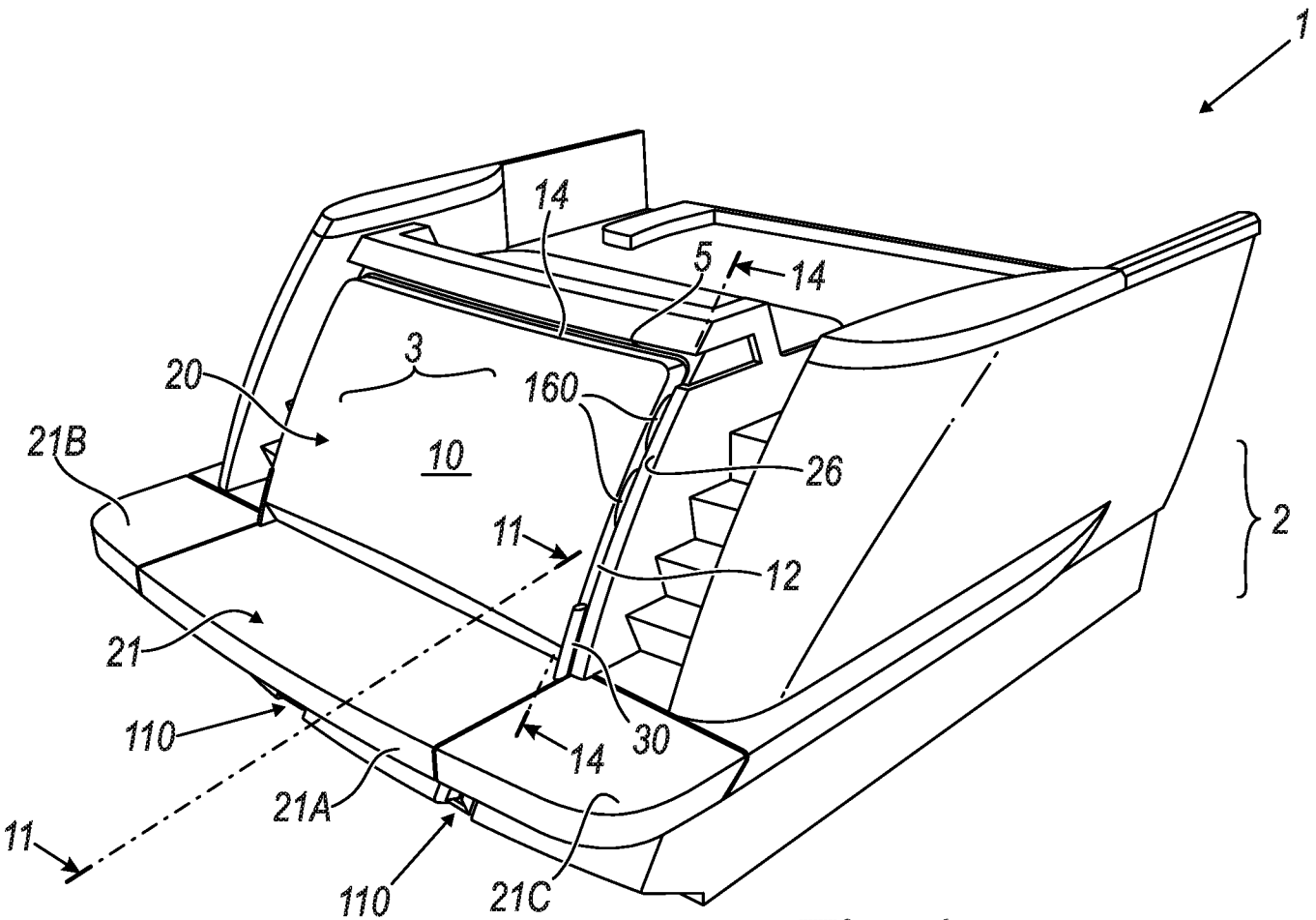
FIG. 1 shows the stern of a boat according to the invention, its stern hatch being closed.
Figure 2:
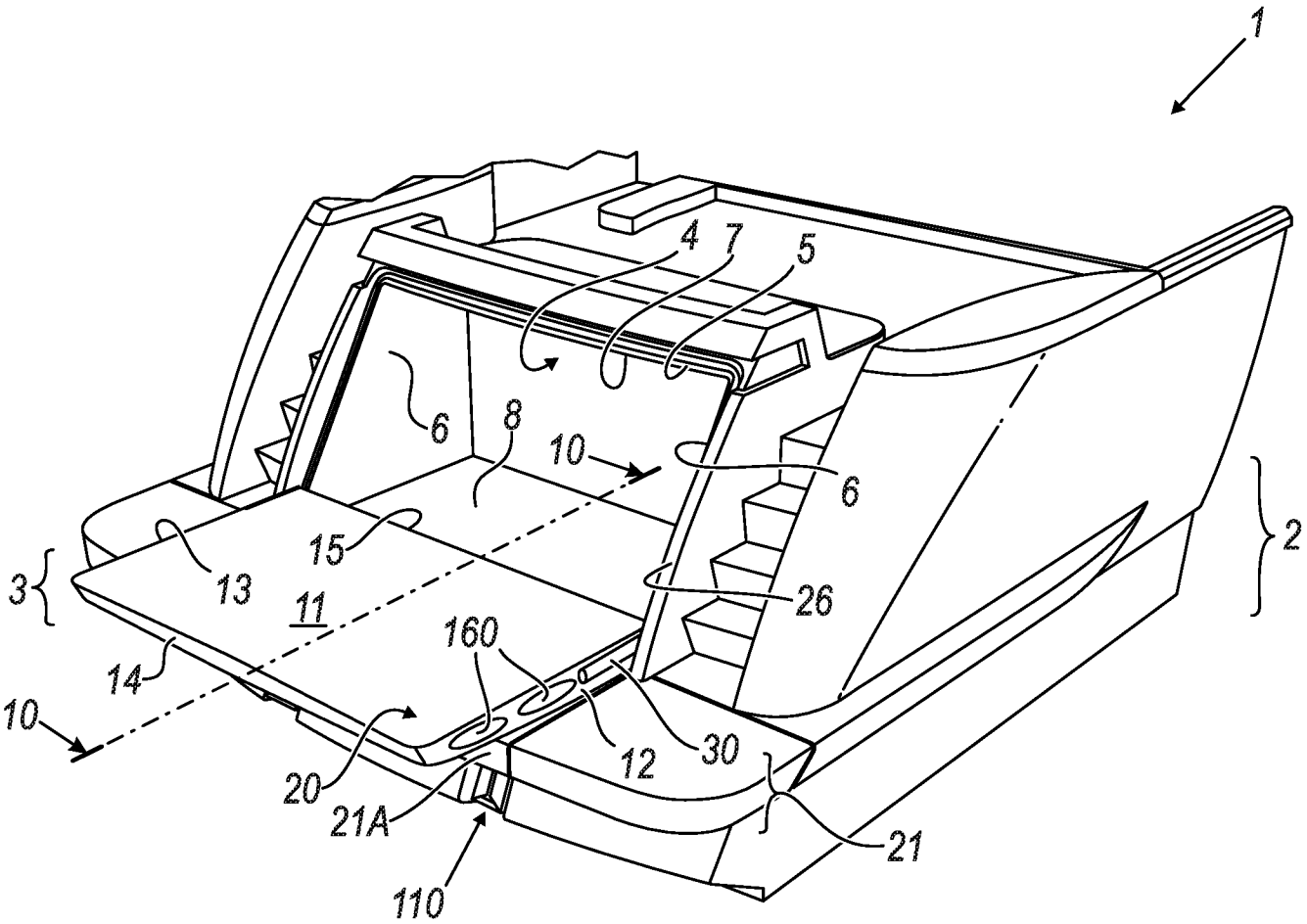
FIG. 2 shows the stern of the boat depicted in FIG. 1, its hatch being open downwards.
Figure 3:
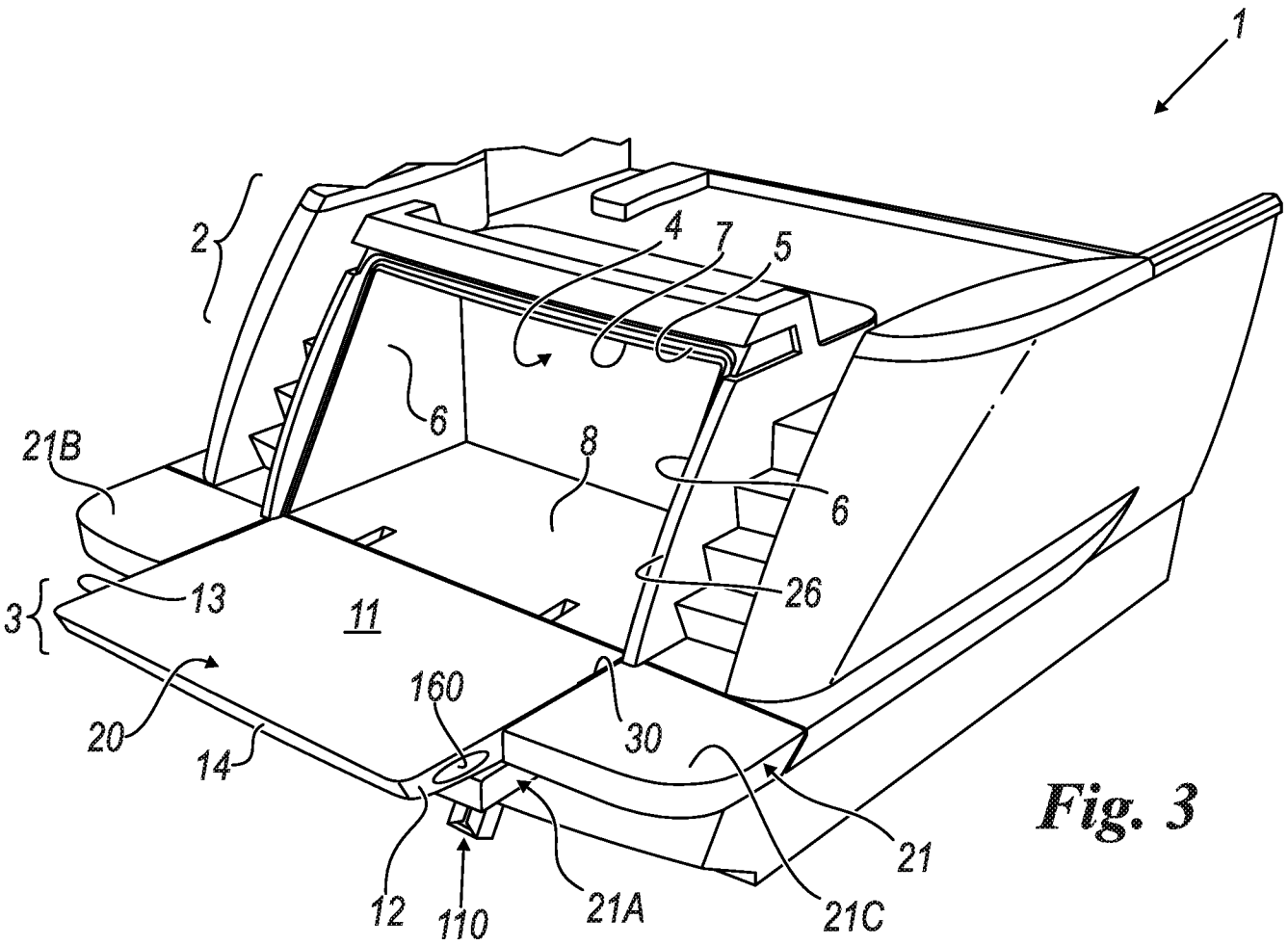
FIG. 3 shows the stern of the boat, its hatch being opened and partially moved toward the water on which the boat floods and aligned to the plane of a stern platform of the boat.

With reference to the mentioned figures, a boat 1 is (partially, in its stern portion only) shown as comprising a hull 2 having a stern hatch 3 suitable for closing a stern compartment 4, for instance suitable for housing a small boat like a rubber dinghy or a tender (150). Such compartment 4 has an aperture 5, opposed side walls 6, an upper part 7, and a lower part 8.

The stern hatch 3 comprises an outer wall 10, an inner wall 11 (generally made of fiberglass, for instance like the hull 2) spaced from each other by sides 12 and 13, upper and lower edges 14 and 15; such walls 10 and 11, said sides 12 and 13, and the (upper and lower) edges 14 and 15 determine a body 20 of the hatch.

Figure 4:
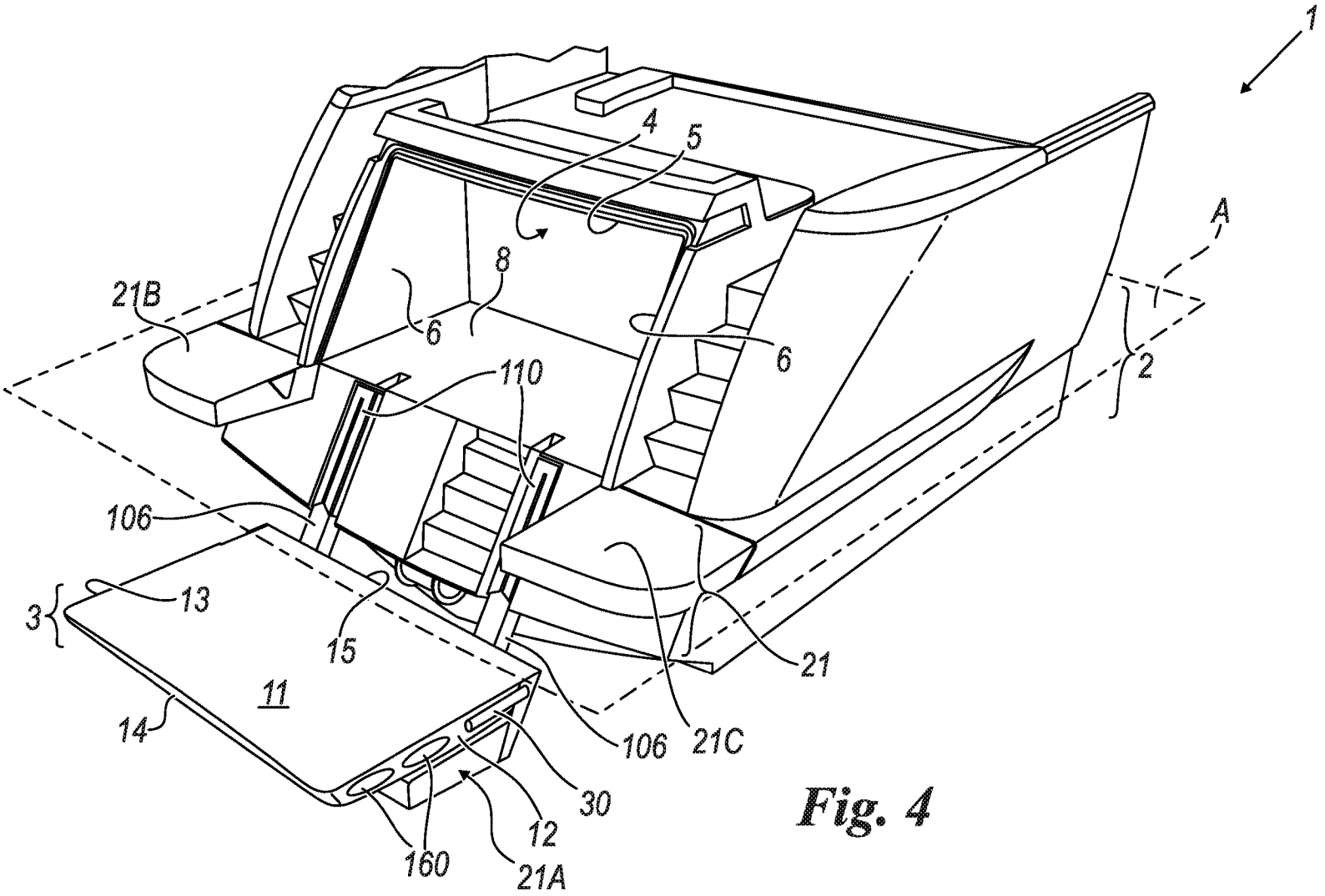
FIG. 4 shows a perspective view, from the stern, of the boat, its hatch being in a position in which it is completely submerged in the water.
Figure 5:
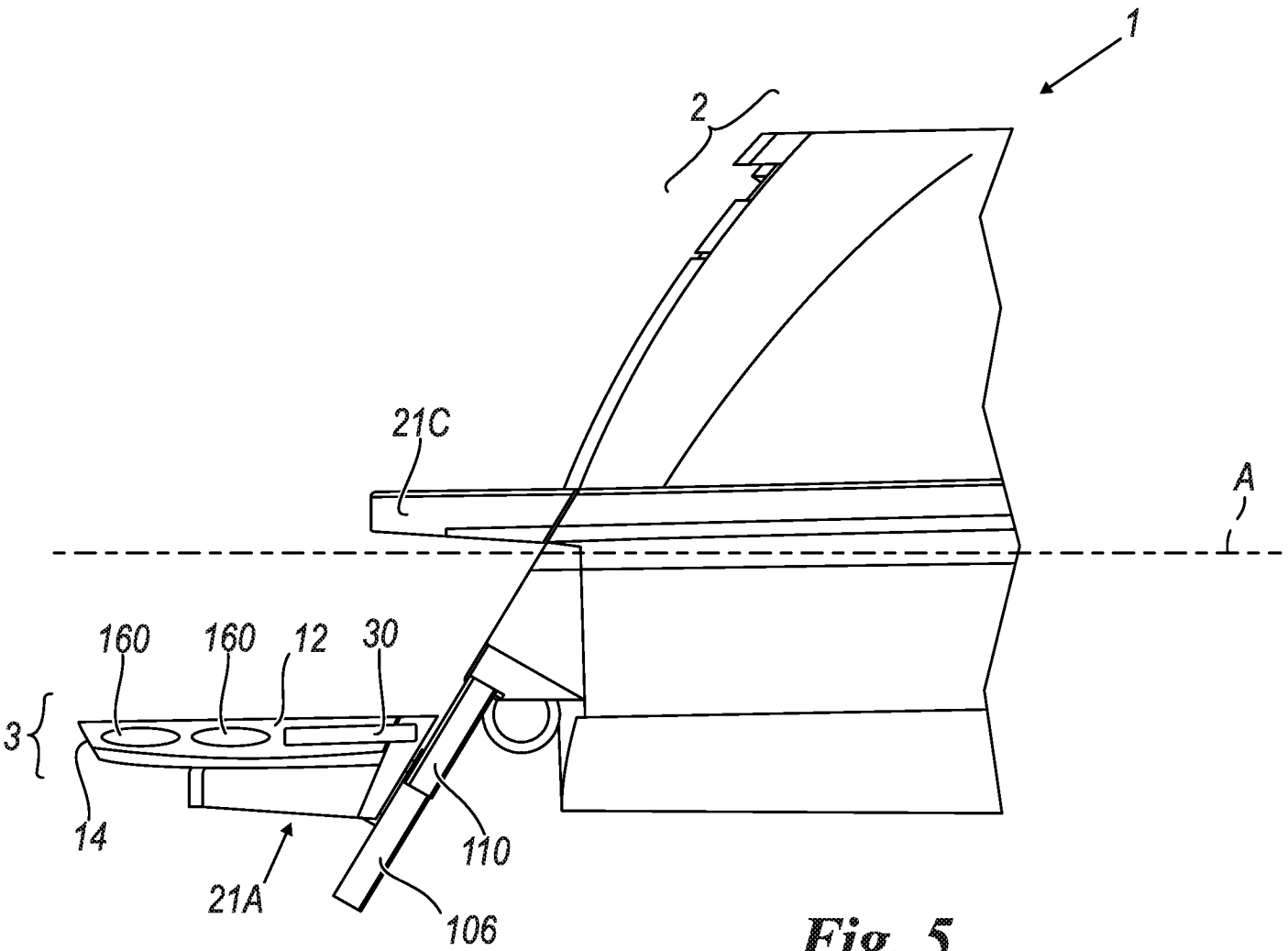
FIG. 5 shows a side view of the stern of the boat, its hatch being in the position depicted in FIG. 4.
Figure 6:
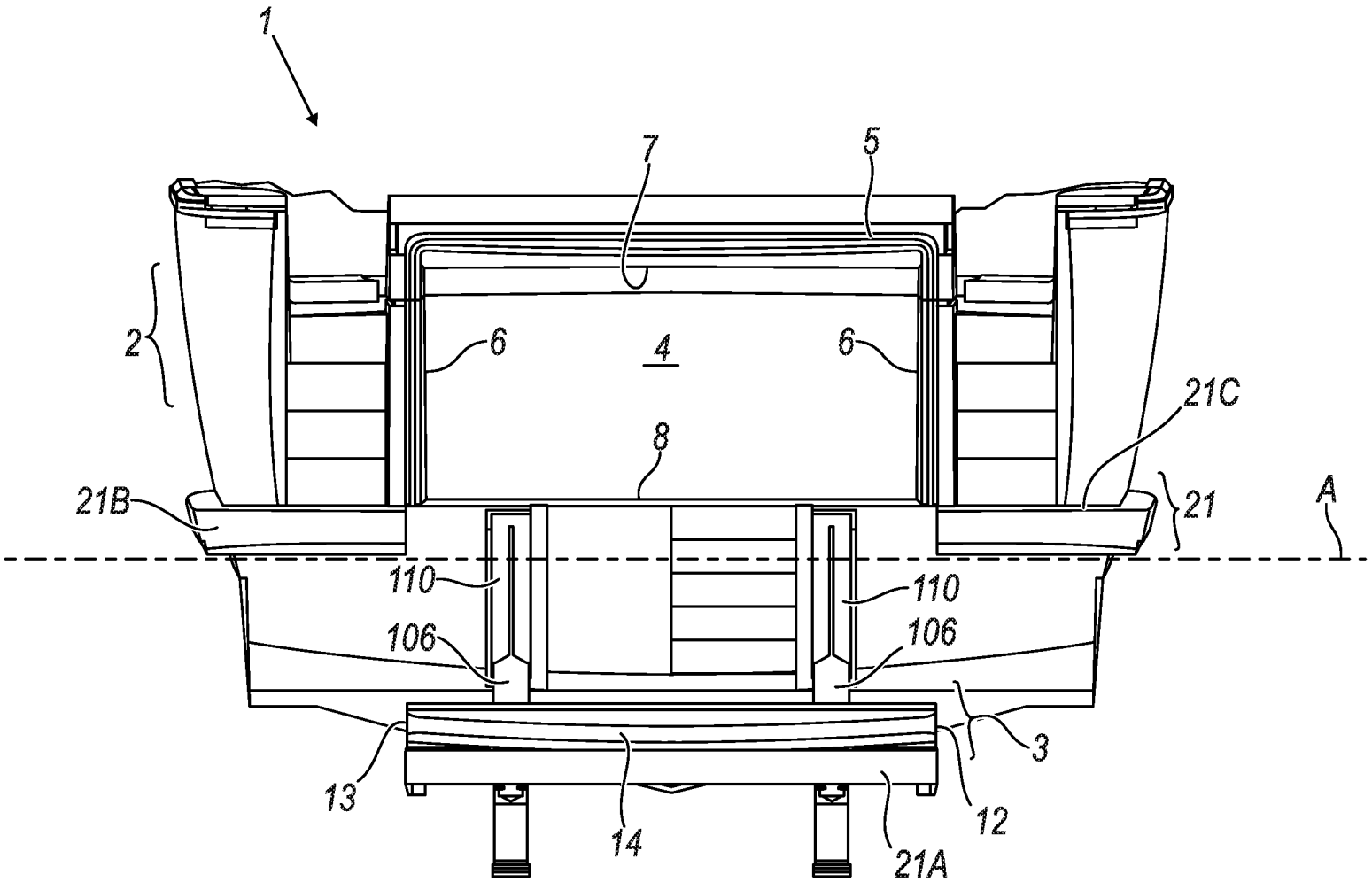
FIG. 6 shows a front view of the stern of the boat, its hatch being in the position depicted in FIG. 4.
Figure 7:
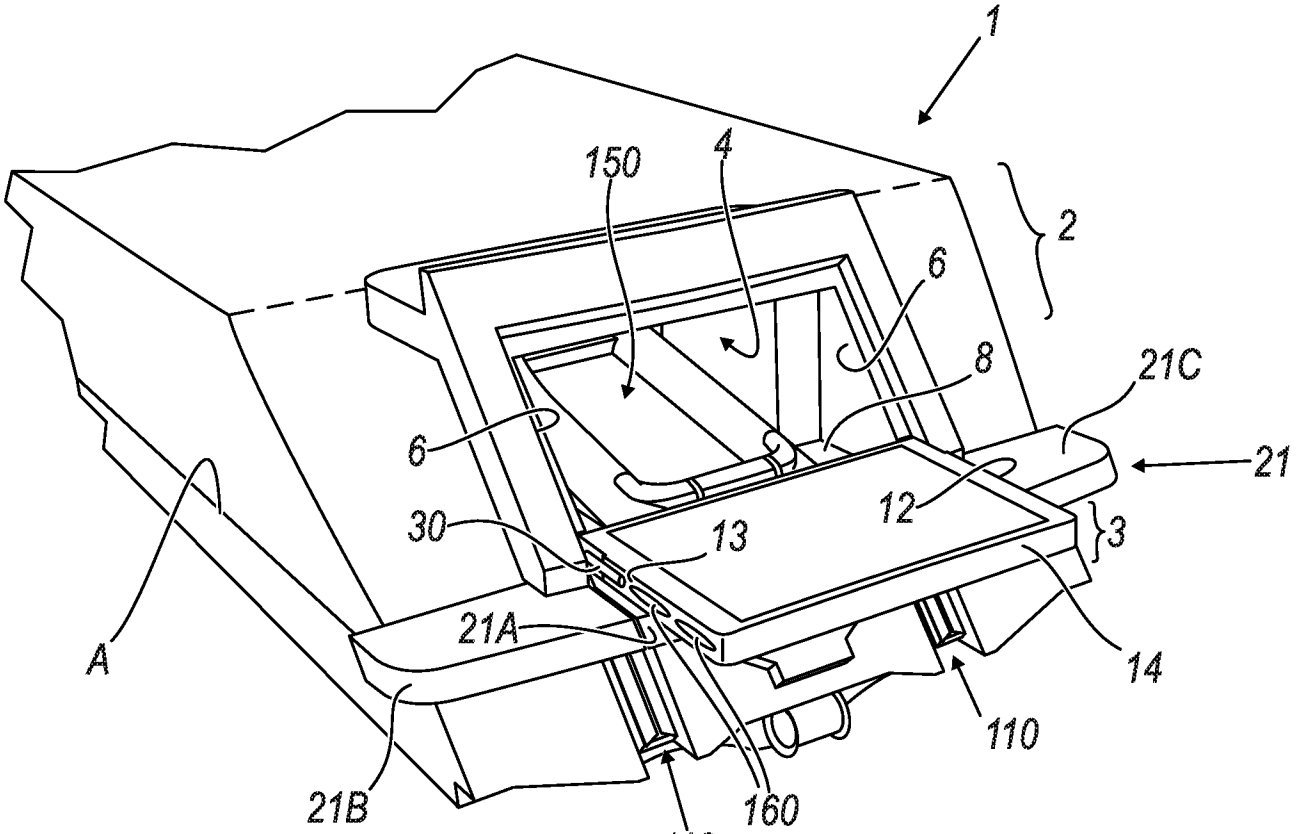
FIG. 7 shows a perspective view, from the stern, of a boat according to the invention in an initial step of opening of the stern hatch suitable for allowing the submersion in water of a rubber dinghy or a tender housed in a stern compartment of the boat.
Figure 8:
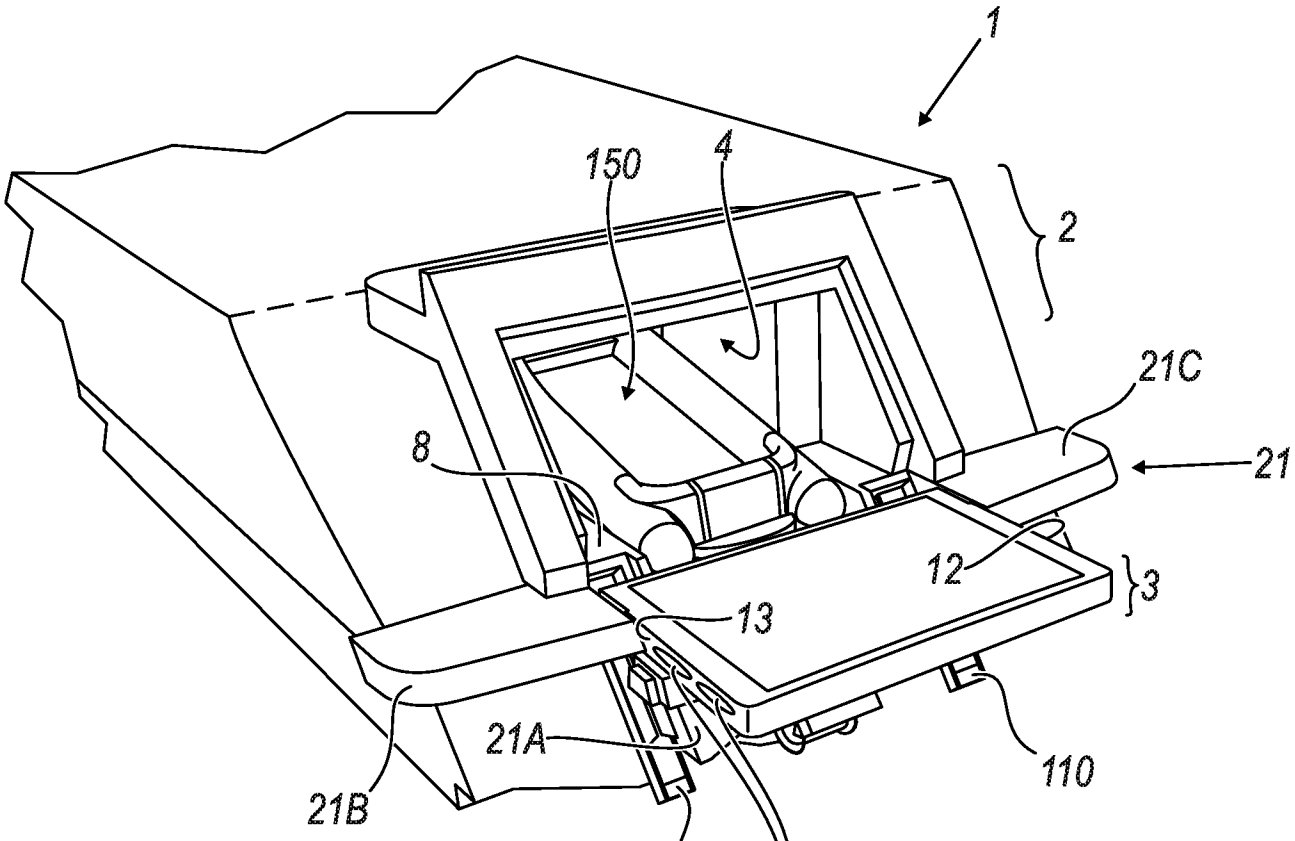
FIG. 8 shows a view similar to that of FIG. 7, the stern hatch being depicted in an instant in time during its lowering, aiming at making the coming out of the tender from the stern compartment easier.
Figure 9:
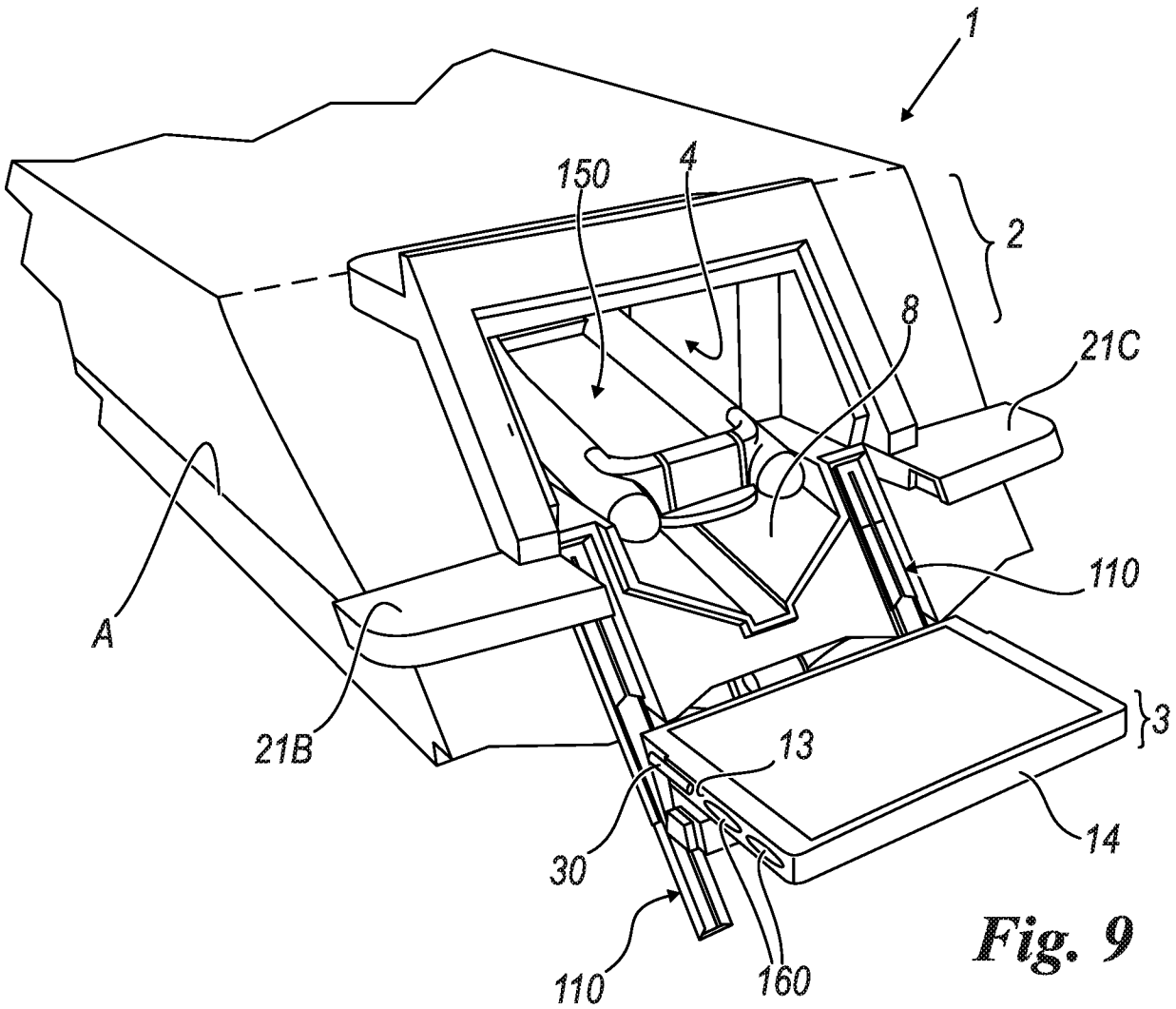
FIG. 9 shows a view similar to that of FIG. 8, the hatch being depicted completely lowered in order to allow the tender to go out from the stern compartment.
Figure 10:
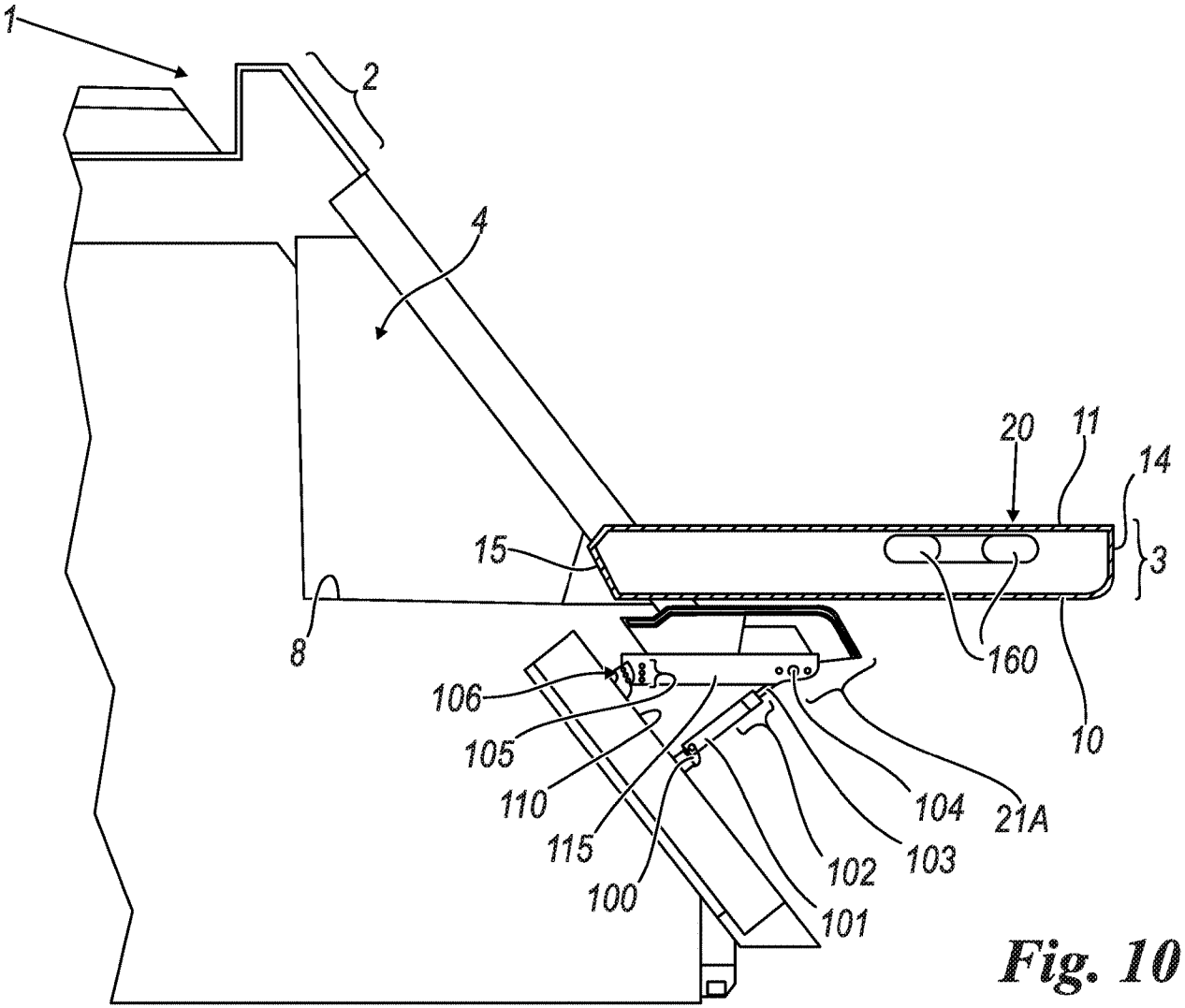
FIG. 10 shows a cross-sectional view according to the line 10-10 of FIG. 2.

The hatch 3 is capable of opening toward a stern platform 21 of the hull 2, i.e. it is capable of opening downwards with respect to the compartment 4. Such platform 21 comprises a central portion 21A that is movable, i.e. suitable for being submerged in the water (on which the boat identified by A in the FIGS. 4, 5, and 6 floats) with respect to side portions 21B and 21C. For instance, see FIG. 10, such movement is obtained by constraining, via a hinge 100, a stem 101 of a (hydraulic, pneumatic, or hydropneumatic) telescopic member 102, to the hull 2; a piston 103 of such member 102 is hinged in 104 to the platform portion 21A, the latter being hinged in 105 to a truck 106 movable through actuators (for instance telescopic members 108) constrained to such hull, along guides 110 integral with the latter. Said portion 21A comprises a part 115 which said member 103 and said truck 106 connect to.

Alternatively, the position 21A is supported by telescopic guides having a fixed part (conceptually corresponding to the fixed guide 110) and a movable part (corresponding to the truck 106), the movable part of said guides being operated in a known (hydraulic, pneumatic, or hydropneumatic) way.

The outer wall 10 of the hatch is suitable for arranging itself in correspondence with a stern wall 26 of the boat 1 when the hatch is closed, said wall 26 delimiting the aperture 5 of the compartment 4.

According to the invention, the stern hatch 3 is associated with actuating means 30 for its opening and closing with respect to the compartment 4, but said means are disengaged from the hull 2. On the contrary, the hatch 3 is engaged to the movable central portion 21A of the platform 21 (which also supports the actuating means 30) and is capable of moving with it. In this way, when the hatch 3 is open, it lean on the portion 21A of the platform and can move therewith in that it is disengaged from the hull 2 and hence it can be submersed in the water together with said portion of movable platform 21A.

Therefore, the actuating means 30 of the hatch are integral with said portion of movable platform in such a way as to allow the hatch to disengage from the hull. Such actuating means 30, schematically depicted in the figures, can be implemented in known manners, for instance through hydraulic, pneumatic or hydropneumatic systems similar to the above described telescopic member 102 (hence not shown in the figures); such actuating means engage the hatch to the platform and move the latter with respect to it, thus bringing it into two operating positions: in a first position the hatch 3 being closed on the compartment 4 whereas in the second position is instead leaning on the movable platform. In this second position, the movement of the platform results in the movement of the hatch being leaned thereon and integral therewith via the actuating means 30.

Therefore, the actuating means 30 allow a rotation of the hatch around an axis in correspondence with the movable platform so as to abut said hatch on said platform. Just as an example, in the figures those means are shown being situated on the edges of the hatch.

The actuating means 30 are suitable for allowing the opening and closing movements of the hatch with respect to the aperture 5 of the compartment 4. The hatch thereby is not provided, as above stated, with any hinge members or further connections to the hull 2 and hence is disengaged from it. It follows that the side walls 6 of the compartment 4 (in the known boats usually carrying telescopic members which allow the movement of the respective hatch) do not support any actuating means of the hatch and such walls are their sides, perfectly smooth.

The fact that the hatch is not rigidly connected to the hull is also to the advantage of safety for the people on board the boat 1, who can freely move inside the compartment 4 without the risk of knocking against parts projecting from its walls or the need to avoid said projecting parts; it follows the advantage of an ease operation in loading means or goods inside such compartment.

The actuating means 30 are controlled by a control unit (not shown in the figures) outside the hatch, indicatively installed in the engine room.

Thanks to the invention, the possibility is achieved of constraining the hatch to the hull of the boat (through the platform 21 or better the portion 21A thereof) without using any specially conceived hinge members and at the same time a hatch movement mode is offered which is fully encased therein (for instance with the means 30 partially installed in the latter and partially installed in the mobile portion 21A), which leads to the advantages indicated above. The hatch according to the invention is therefore not rigidly connected to the boat. This allows to obtain movements of the hatch itself not possible in solutions according to the present state of the art, like that described in the present text and relevant to the submersion of said hatch into the water.

The hatch 3 having been opened as described above, moving (i.e. lowering) the portion 21A of the stern platform in the direction to the water, so as to submerge it therein, makes the hatch 3 sink together with the platform.

As a matter of fact, thanks to the hatch 3 being constrained, through the actuating means 30, to the movable portion 21A of the platform, lowering the latter into the water results in lowering into such water the complete hatch 3 which, when open, leans on said platform. The hatch being sunk completely sets the aperture 5 of the compartment 4 free. In this way, should the latter be suitable for housing a tender or rubber dinghy 150, this means can be simply lowered into the water (which, the hatch being sunk, can partially enter such compartment 4) and as simply hauled in the compartment 4.

For this purpose, the lower wall 8 comprises, in this solution, an inclined-plane configuration which facilitates the movement of the tender 150, obtained for instance through a usual winch fixed to an inner wall of the compartment 4 (not shown in the figures).

It is worth noting that the sunk hatch also operates as a support to board the tender or rubber dinghy when it is already floating or to load equipment, for instance stub diving cylinders, thereon. In order to facilitate the access of people onto the sunk hatch, it might be worth to indicate that steps can be provided on the transom of the boat to facilitate the coming and going of guests to/from the submerged small beach determined by said hatch.

Water possibly enters the hatch during submersion, which makes the lowering into water easier. For this purpose, on its sides 12, 13 and in the wall 15 one or several slots 160 are provided (the figures show, wherever possible, only those in the side 12 and in the wall 15) to let water go in. Such holes make also it possible for water to go out when the hatch 3 goes out of the water.

A specific embodiment of the invention has been described. However, others can be obtained, like that which comprises pumps inside the body 20 of the hatch to remove the water entering it, but always comprising actuating means 30 constantly connected to the portion of platform 21A, for instance at least one telescopic member which is hydraulically, pneumatically or hydropneumatically operated, said member connecting the movable platform 21A to the hatch 3.

The invention claimed is:

1. A boat comprising a hull provided with a rear stern hatch located in correspondence with an internal stern compartment of said hull and suitable for opening and closing in correspondence with an aperture of said compartment, said hatch having a body with opposed sides located in correspondence with side walls of said compartment and upper edge and lower edge, said hull also having a movable and submergible stern platform, wherein the hatch has no direct connections to the hull, but the hatch is connected to the stern platform in such a way as to reach, upon opening, a position submerged in the water where the boat is located in the moment when said platform submerges into said water, actuating means being provided to move the hatch integral with the movable stern platform and suitable for allowing the opening and the closing of the compartment of the hull by moving said hatch.

2. The boat according to claim 1, wherein said actuating means comprise at least one telescopic member integral with the hatch and with the movable platform.

3. The boat according to claim 2, wherein said telescopic actuating member is alternatively a hydraulic, pneumatic, hydropneumatic or electric telescopic actuating member.

4. The boat according to claim 2, wherein said telescopic actuating member is alternatively a hydraulic, pneumatic, or hydropneumatic telescopic actuating member, and is controlled by a control unit installed outside the hatch.

5. The boat according to claim 1, wherein the actuating means constrain the hatch to the movable stern platform and enable the hatch, upon opening and said movable platform being submerged, to reach a position submerged in the water where the boat is located.

6. The boat according to claim 1, wherein the stern platform comprises three adjacent portions, one portion interposed between the remaining two being movable, defining the movable stern platform, and carrying the actuating means of the hatch, the remaining portions of the stern platform being fixed to the hull.

7. The boat according to claim 1, wherein the movable stern platform cooperates with actuator members suitable for allowing its movement with respect to the hull, said actuator members comprising a portion fixed to the hull and a portion movable with respect to that portion fixed to the hull, the movable platform being constrained to the portion fixed to the hull.

8. The boat according to claim 1, wherein the stern compartment is floodable.

* * * * *